United States Patent [19]

Chazin

[11] Patent Number: 4,787,856

[45] Date of Patent: Nov. 29, 1988

[54] PRINTED CIRCUIT BOARD EJECTION INSERTION TAB

[75] Inventor: Morris Chazin, Willingboro, N.J.

[73] Assignee: General Electric Company, Schenectady, N.Y.

[21] Appl. No.: 28,269

[22] Filed: Mar. 20, 1987

[51] Int. Cl.[4] ..... H01R 13/62

[52] U.S. Cl. ..... 439/152; 439/476

[58] Field of Search ..... 439/152, 153, 155, 156, 439/160, 476; 361/399, 413, 415, 400, 414

[56] References Cited

U.S. PATENT DOCUMENTS

| | | | |
|---|---|---|---|
| 3,489,954 | 1/1970 | Humphrey et al. | 361/413 |
| 3,573,558 | 4/1971 | Babcock | 361/399 |
| 4,001,797 | 1/1977 | Buss et al. | 361/415 |
| 4,434,537 | 3/1984 | Bean et al. | 361/399 |
| 4,603,375 | 7/1986 | Miller et al. | 439/160 |
| 4,648,009 | 3/1987 | Beun et al. | 361/415 |

OTHER PUBLICATIONS

"Scanbe's New Card File Components System Here's How," pp. 3, 5, 17–19.

*Primary Examiner*—David Pirlot

*Attorney, Agent, or Firm*—William Squire; James C. Davis, Jr.; Paul R. Webb, II

[57] ABSTRACT

A tapered wedge-like member has a shoulder which abuts a printed circuit board edge. A yoke extending from the shoulder is pinned to a corner of the board. Two such tabs are attached to two corners of the board for providing finger accessible extraction of the board from a connector.

1 Claim, 1 Drawing Sheet

PRINTED CIRCUIT BOARD EJECTION INSERTION TAB

This invention relates to devices for ejection of printed circuit boards from mating connectors.

Printed circuit boards are interconnected with other printed circuit boards and related circuitry by mating connectors. Many circuit boards have a large array of connecting pads which are inserted into a connector. The pads are aligned in an array for mating with a linear array of contacts in the connector. Each contact of the connector needs to be resiliently displaced and, therefore, provides a friction insertion and retraction load on the board. A large array of connector contacts and mating printed circuit board pads requires a relatively large insertion and retraction force on the board.

One solution to the problem is to provide zero force connectors in which the contacts of the connectors are cammed out of the way of the board. However, these are relatively expensive and more difficult to implement because they require access to the connector which is not always possible. The remaining situations in which connectors have fixed-in-place contacts presents more of a problem.

To deal with this problem, a line of different kinds of devices have been developed for board insertion-extraction. One common system preforms the board with holes along an edge thereof. A tool mates with those holes and is inserted in the holes for providing a handle for gripping the tool and inserting and, more importantly, retracting the board. A tool is usually required to retract the board because often the boards are closely spaced to one another and there is very little room for manual insertion of fingers against the board for pulling the board and overcoming the retraction force. Many such board retraction devices have been developed; however, all relate to the concept of providing a separate device which is releasably secured to the board.

A second line of devices developed for removing boards includes movable ejectors and pullers which act as cams. These pullers are attached by mounting pins to the circuit boards and operate by lever action against the adjacent board guide to displace the board from its connector. These type of devices are relatively bulky and, more importantly, require a structure adjacent thereto from which lever forces can be imparted to the device. Further, these type of devices as well as the aperture type of pullers may take up a relatively large amount of board real estate or otherwise interfere with the use of the board in mating board guides, such as in racks and similar structures.

A printed circuit board ejection-insertion tab according to the present invention comprises a finger gripping member dimensioned to engage a board ejection-insertion finger. Means are provided for rigidly securing the member to a corner of the board such that the member projects cantilevered from the board at one edge of the board and approximately coplanar with a line defined by a second edge of the board intersecting the one edge. By providing a tab which is secured to the board at each of two opposite corners of the board, relatively little room or real estate on the board is taken up by the tab and relatively little interference is present by insertion of the board into its mating guide and support structure. Because the tab is closely spaced to the projecting edge of the board, it is easily accessible manually for finger gripping.

Figure 1:
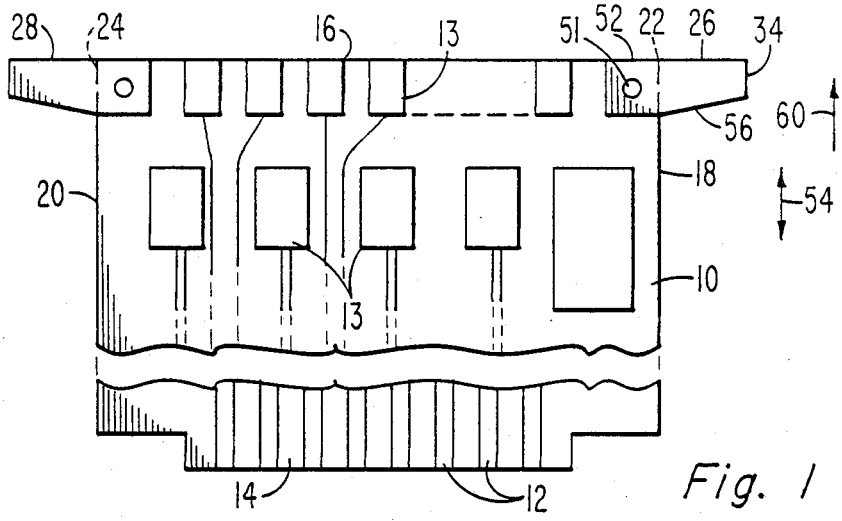
FIG. 1 is an elevation fragmented view of a printed circuit board assembly employing a tab according to one embodiment of the present invention.

In FIG. 1, printed circuit board 10 has an array Of contact pads 12 at one edge 14. Pads 14 are adapted to make contact with a printed circuit board connector (not shown) in a conventional way. The board 10 includes circuitry and components 13 which cover most of the areas of the board broad surface. Board 10 is generally rectangular having a straight edge 16 parallel to edge 14 and two side edges 18 and 20 which form with edge 16 respective corners 22 and 24. Corners 22 and 24 are right angles.

Figure 2:
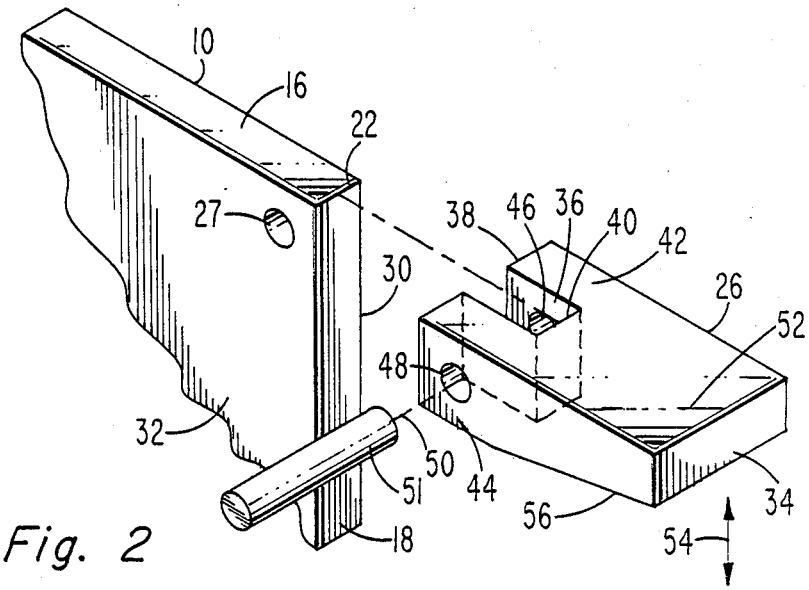
FIG. 2 is an exploded view of one corner of the board of FIG. 1 illustrating the construction of a tab according to that embodiment.
Figure 3:
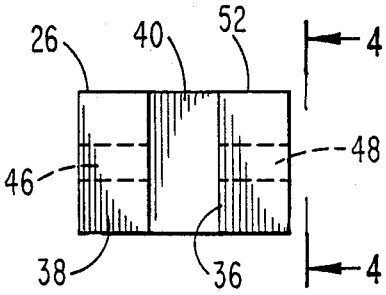
FIG. 3 is an end elevation view of the tab of FIG. 2.
Figure 4:
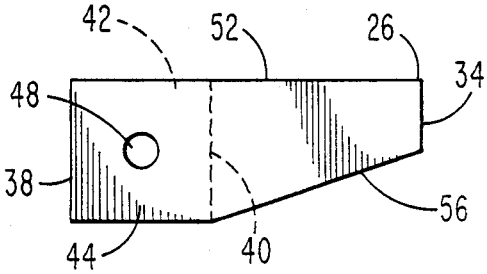
FIG. 4 is a side elevation view of the tab of FIG. 3 taken along lines 4—4.

Attached to corner 22 is a tab 26 according to the present invention and an identical tab 28 at corner 24. The following description of tab 26 at corner 22 is representative. In FIG. 2, board 10 has a hole 27 at corner 22 completely through the board substrate and in communication with opposite board broad surfaces 30 and 32. Hole 27 preferably is equidistant from edge 16 and edge 18. Tab 26 is a somewhat trapezoidal solid having a rectangular end 34 and a slot 36 at end 38 opposite end 34. Slot 36 has a planar bottom wall surface 40 which forms a shoulder which abuts the planar surface of board edge 18. Slot 36 is sufficiently wide to closely receive and straddle the board surfaces 30 and 32. Slot 36 forms end 38 into two legs 42 and 44. Leg 42 has a hole 46 of the same diameter as hole 27. Leg 44 has a hole 48 identical to and aligned with hole 46 on axis 50. Leg 44 overlaps surface 32 and leg 42 overlaps surface 30. Holes 46 and 48 align with board hole 27 when slot bottom wall surface 40 abuts edge 18.

A pin 51 is inserted in holes 46 and 48 and 27 to lock tab 26 to board 10 at corner 22. When so locked, the abutment of surface 40 with edge 18 precludes the tab 26 from rotating about axis 50. Surface 52 of tab 26 is coplanar with edge 16 when the tab is so secured to board 10. The tab has a relatively small dimension in directions 54, e.g., $\frac{1}{4}''$, and tapers at surface 56 toward end surface 52 at end 34 to provide a wedge-like construction. The taper of surface 56 commences at about the region adjacent edge 18 when tab 26 is secured to board 10.

Tab 26 is identical, as mentioned before, to tab 28 and is secured to the board 10 at corner 24 abutting against edge 20. Thus, tabs 26 and 28 are mirror images of one another when secured to the board. The tabs thus fixed to the board are rigidly secured to the board, are aligned coplanar with the surface of edge 16 so as to take no more room in a direction 60, FIG. 1, than the board 10. The tabs 26 and 28 are relatively shallow in directions 54 and take up relatively little room in these directions.

By way of example, legs 42 and 44 where they are juxtaposed with the board broad surfaces 30 and 32 respectively, cover a region of about $\frac{1}{4}''$ square. End 34 may have a height in directions 54 of about $\frac{1}{8}''$. The tab may extend from surface 40 to end 34 about $\frac{3}{8}''$.

The tabs 26 and 28 are cantilevered sufficiently from the board 10 to provide sufficient area of tapered surface 56 for the finger of a person. By manually engaging the tabs the board 10 is ejected from a connector in directions 60 by simultaneously applying a force to each of tabs.

Because the tabs are rigidly attached to the board, they do not rely on a lever action or require adjacent structure for ejection. Also, the tabs project in a relatively small volume beyond the board so that they essentially do not interfere with the full insertion of the boards in their mating guides at edges 18 and 20. The tabs may have a width into the plane of the drawing of FIG. 1 30 of about ¼" and therefore take up relatively little volume in that direction so that the boards may be inserted closely spaced to one another in an array in a rack arrangement. The tabs may be made of rigid material such as hard thermoplastic materials or other materials which can be easily molded or formed to provide a relatively inexpensive but efficient structure for removal of the boards from the mating connectors. The tabs may also be use for insertion of the boards into the connectors should the remainder portions of the edge 16 of the board be occupied by components which should not be physically engaged during the insertion process.

What is claimed is:

1. In combination:

a printed circuit board having first and second edge surfaces meeting at a corner and an aperture through the board spaced from said edge surfaces;

a retraction tab secured cantilevered from and abutting the first edge surface, said tab including a pair of legs straddling said board at said first edge surface; and a pin secured to the legs and passing through said aperture for securing the tab to the board, said abutment with said first edge surface being arranged to preclude the tab from rotating about said pin, said tab being dimensioned so that when secured to the board said tab including said legs is at most flush with said board second edge surface.

* * * * *